US005337457A

United States Patent [19]

Chennault

[11] Patent Number: 5,337,457

[45] Date of Patent: Aug. 16, 1994

[54] NECKWEAR ANCHORING DEVICE

[76] Inventor: Kennith Chennault, 215 Dickinson, Lewisville, Tex. 75067

[21] Appl. No.: 27,456

[22] Filed: Mar. 8, 1993

[51] Int. Cl.[5] ..... A44B 6/00

[52] U.S. Cl. ..... 24/49 R; 24/49 CF; 24/56; 2/145

[58] Field of Search ..... 24/49 R, 49 CF, 49 CC, 24/49 C, 49 S, 49 TS, 49 A, 54, 55, 56, 57; 2/145, 144

[56] References Cited

U.S. PATENT DOCUMENTS

| | | | |
|---|---|---|---|
| 3,042,983 | 7/1962 | Riedler | 24/49 CF |
| 3,381,865 | 5/1968 | Pehr | 2/145 |
| 3,474,503 | 10/1969 | Less | 24/56 |
| 3,802,032 | 4/1974 | Weed | 24/49 |
| 3,890,678 | 6/1975 | Leonard, Jr. | 24/49 |
| 4,219,909 | 9/1980 | Anderson | 24/49 |
| 4,262,393 | 4/1981 | Neri | 24/49 CF |
| 4,554,710 | 11/1985 | Grant | 24/49 |
| 4,827,576 | 5/1989 | Prince, Jr. | 24/49 |
| 4,920,579 | 5/1990 | Swain | 2/145 |
| 4,959,889 | 10/1990 | Claravino | 24/49 |
| 4,972,523 | 11/1990 | Begg | 2/145 |
| 5,109,547 | 5/1992 | Abdallah | 24/49 |
| 5,216,785 | 6/1993 | Graef | 24/49 CF |
| 5,245,708 | 9/1993 | Campelia et al. | 2/145 |

FOREIGN PATENT DOCUMENTS

| | | | |
|---|---|---|---|
| 2597731 | 10/1987 | France | 24/49 CF |

*Primary Examiner*—Victor N. Sakran

[57] ABSTRACT

A neckwear anchoring device (10) for retaining neckties (23) and the like in their intended position along the front portion of the wearer's garment (12). The anchoring device is received by the tie loop (22) and attaches to the button threads of selected buttons (24 and 26) on the shirt or blouse of the wearer. The device (10) engages the button threads by sliding behind the button without the need for inserting the button through a buttonhole. The device (10) is easily installed and removed by the wearer.

11 Claims, 1 Drawing Sheet

NECKWEAR ANCHORING DEVICE

FIELD OF THE INVENTION

The present invention generally relates to a neckwear anchoring device. More particularly, the present invention discloses a device which loosely anchors the elongated portions of a necktie to the shin or blouse of the wearer and which is easily attached and removed by the wearer.

BACKGROUND OF THE INVENTION

Neckwear is a common apparel accessory. The necktie has become a standard component of formal and business dress, and the necktie has even become popular as informal attire. Neckties are available in a variety of styles and colors, so a wearer may select a tie that complements his wardrobe.

When in use, a necktie has front and rear extended portions which extend downward from the knotted portion of the tie. The extended portions are intended to lay flat against the wearer's blouse or shin with the wider portion coveting the more narrow rear portion. The wider extended portion typically has a horizontally disposed loop of fabric on its rearward side, and many wearers place the narrower rear extended portion through the tie loop so that both portions will hang from the knotted portion as a single unit.

The extended portions of a necktie are not attached to the wearer below the knotted portion of the tie. Therefore, the extended portions can be blown about by the wind or shifted by the movement of the wearer. In addition, if a coat, sweater or other garment is worn over the tie, the fie can be moved or shifted when the garment is put on or taken off. As a result the wearer fails to achieve his or her goal of a well-tailored look, and the wearer must continually adjust and reposition the tie.

In addition to the positioning problems, the frequent movement of the extended portions of a necktie can cause the fie to loose its shape. The tie may become wrinkled or creased, which ruins the appearance of the tie, or it may contact a rough surface which can snag and pull small threads from the fabric. Neckwear is often stained by contacting food or beverage as the wearer leans over a table or by contacting water as the wearer leans over a basin to wash his hands.

Problems associated with the extended portions of a necktie are well recognized, and many attempts have been made to anchor the extended portions to the wearer. However, prior attempts have failed to produce an inexpensive and easily installed anchoring device that will not damage the tie.

The best known anchoring devices are generally known as tie tacks, tie bars, tie chains and tie clips. These devices often damage the necktie due to the way in which they are attached to the tie. Tie tacks are especially harmful because the tack portion punctures the tie fabric every time it is used. Repeated use of tie bars, tie clips, and tie chains also destroy the integrity of the tie because they eventually cause a crease or wrinkle. These devices are frequently manufactured of polished metal and sold as jewelry because they are plainly visible; therefore, they detract from the appearance of the tie. Finally, these devices frequently prevent any movement of the tie at the point where the device is attached, so the tie does not hang naturally from the knotted portion.

Other devices have also been introduced which were intended to provide anchoring without being seen and without damaging the tie. However, the devices have been largely unsuccessful. For example, U.S. Pat. No. 4,827,576 to Prince discloses a necktie anchoring device comprising a vertically slotted base member which is permanently attached to a tie loop and engages a button of the wearer's shirt or blouse. Because the anchoring device is permanently attached to the tie, a separate device must be purchased for each of the wearer's ties. The permanently attached anchoring device may also interfere with tying of the knotted portion of the tie. The device is attached to the wearer's shin by passing a button through one of the button slots; however, attachment may be difficult because the device is constructed of a material having a greater relative stiffness than a tie.

U.S. Pat. No. 4,972,523 to Begg discloses a two-piece necktie retaining device. The first piece comprises hook and loop fastening material permanently secured to the back side of the front extended portion of the tie, and the second piece comprises a tubular band of hook and loop type fabric material which can receive the rear extended portion of the tie. The tubular strip of material also has a single button hole for the insertion of a button on the wearer's shin. Because one piece of the retaining material is permanently attached to the tie, the wearer must purchase a separate device for each of his ties. The retaining material may interfere with tying the knotted portion of the tie, and its attachment may deform the tie causing irreparable harm.

U.S. Pat. No. 4,554,710 to Grant discloses a tie anchoring device comprising a crossbar member for inserting into a button hole of the wearer's shirt and a flexible thread extending between the crossbar and a two-piece fastener. The first anchoring member is permanently attached to the back of the tie, so the device can only be used on one tie. The second fastening member is attached to the flexible thread. The method of permanent attachment may damage the fie and interfere with tying the knotted portion.

U.S. Pat. No. 5,109,547 to Abdallah discloses a neckwear anchoring device comprising a base member and an attached button attachment member. The base member is permanently attached to the necktie, and the button attachment member includes a button hole formed therein. The wearer must insert a button through the button hole while the anchoring device holds the tie in close relationship with the button. The device can only be used for a single tie because the base member is permanently attached to the tie. In addition, the base member is disclosed as being $5\frac{3}{4}''$ long and constructed of a material having a moderate stiffness, so the base member would interfere with tying of the knotted portion of the tie and would cause the tie to hang improperly.

Therefore, a need exists for a tie anchoring device that can effectively anchor a tie in its intended position without damaging the tie. The anchoring device should allow the extended portions to move or shift slightly so that the tie hangs naturally from the knotted portion. In addition, the anchoring device should be hidden from frontal view, easily installed and removed, and usable on different ties.

SUMMARY OF THE INVENTION

The present invention relates to an elongated anchoring device intended to pass through the tie loop on the back of the extended portion of neckwear and having two attachment members to engage the shirt or blouse of a wearer. Each attachment member comprises a slot which can receive and retain the thread or threads which hold a button on the shirt or blouse. The result is a tie anchoring device that is hidden from frontal view and that does not harm the tie. The tie anchoring device does not prevent the narrow rear extended portion from passing through the tie loop concurrently with the tie anchor, so that both extended portions are effectively anchored. The tie anchor can be made of a transparent and flexible plastic so that the anchoring device is not easily seen even if the wearer leans forward. Moreover, the anchoring device can be easily and quickly installed because each attachment member can engage the threads behind a button without requiting the button to be passed through a hole or slot.

The width and length of the anchoring device allows the tie to move vertically and horizontally, limited by the width of the tie loop and the distance between the adjacent buttons. Therefore, the tie hangs naturally along the wearer's blouse or shin, and the tie exhibits some normal movement.

In addition, the anchoring device can be attached to men's shirt and women's blouses despite the difference in distance between adjacent buttons.

BRIEF DESCRIPTION OF THE DRAWINGS

For a more complete understanding of the present invention, and for further details and advantages thereof, reference is now made to the following Detailed Description taken in conjunction with the following drawings, in which.

DETAILED DESCRIPTION OF THE DRAWINGS

Figure 1:
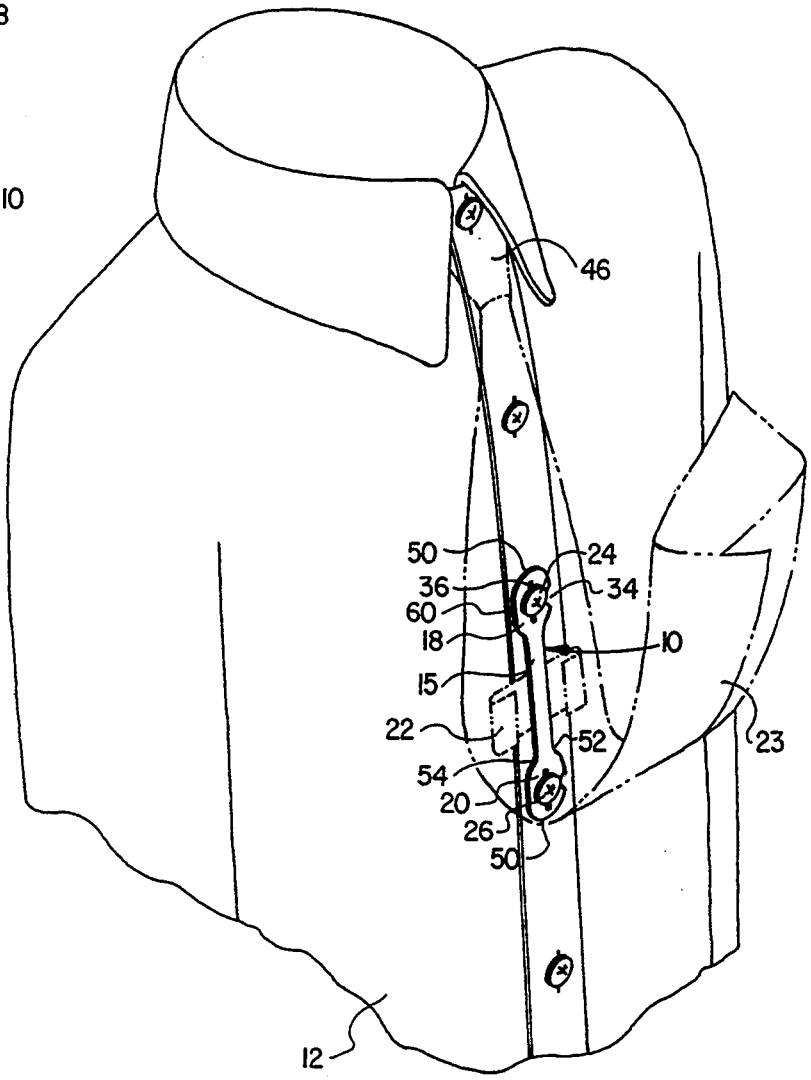
FIG. 1 is a perspective view of a neckwear anchoring device that has been constructed in accordance with this invention.

The present invention relates to a tie anchoring device that overcomes many of the disadvantages found in the prior art. Referring to FIG. 1, a tie anchoring device 10 embodying the present invention is shown in perspective view attached to garment 12. The tie anchoring device 10 includes base member 15 and attachment members 18 and 20. Base member 15 is received by tie loop 22 of necktie 23. Attachment member 18 engages the thread, fiber, or filament, collectively known as button threads, that connect button 24 to garment 12. Attachment member 20 engages the button threads of button 26.

Figure 2:
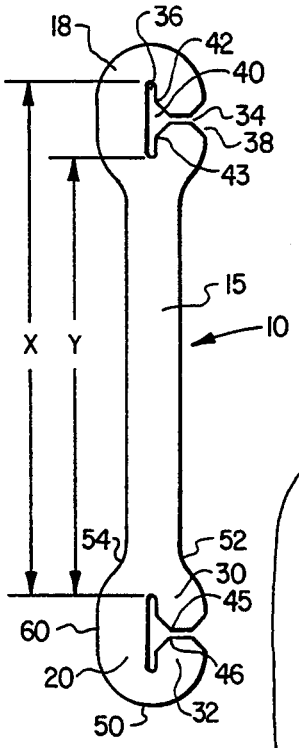
FIG. 2 is a front view of a tie anchoring device shown in FIG. 1.

In FIG. 2, the anchoring device 10 embodying the present invention is shown in a front view. Attachment members 18 and 20 each have extended portions 30 and 32 which define access slot 34 and retaining slot 36. Access slot 34 also includes engagement guide 38 and release guide 40. Retaining slot 36 contains retaining lips 42 and 43, and access slot 34 includes retaining lips 45 and 46.

Figure 3:
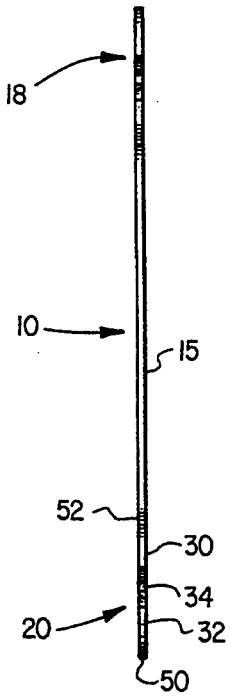
FIG. 3 is a side view of a tie anchoring device shown in FIG. 1.

FIG. 3 provides a side view of the present anchoring device 10. A relatively thin material is used to produce the substantially flat anchoring device 10.

In FIGS. 1 through 3, the width of tie anchoring device 10 allows it to be received by tie loop 22. Exterior edges 50, 52 and 54 of attachment members 18 and 20 are rounded to allow the anchoring device 10 to easily pass through the tie loop 22. Attachment member 18 engages the button threads of button 24 without inserting button 24 through a button hole or slot. Instead, attachment member 18 slides behind button 24 where the button threads are received into access slot 34 and then received and retained by retaining slot 36. The button threads are retained by the width of retaining slot 36 which is narrower than the width of the bundle of button threads and by the stiffness of the resiliant material of construction that forms retaining slot 36. Thus, the button threads do not freely slide within retaining slot 36. Engagement guide 38 ensures alignment of the button threads with access slot 34 during installation. As the wearer applies force to edge 60 to have the attachment member 18 engage the button threads, extended portions 30 and 32 may temporarily deform and expand access slot 34 to allow the button threads to pass through access slot 34 and be received by retaining slot 36. Attachment member 20 engages the button threads of button 26 in the same manner.

In one embodiment, length Y is the distance between adjacent buttons on women's apparel, and length X is the distance between adjacent buttons on men's apparel. Typically, the distance between adjacent buttons on women's apparel is about 3.0 inches, and the distance between adjacent buttons on men's apparel is about 3.5 inches. Thus, the distance between length Y and length X, which is aim the length of retaining slot 36, is about 0.5 inches, and anchoring device 10 can be used on any garment having adjacent buttons spaced between about 3.0 inches and about 4.0 inches apart. Therefore, when device 10 is used on women's apparel, the button threads will assume position in the retaining slot 36 away from the access slot 34 preventing unintentional release of the threads. When device 10 is used on men's apparel, once the threads are within the retaining slot 36, the device 10 can be moved vertically downward, for example by applying a downward force on surfaces 52 and 54, so the button threads are positioned at the top of each retaining slot 36 and away from access slot 34. The downward positioning also secures the device 10 in a stationary position on the wearer's shirt or blouse. Retaining lips 42, 43, 45 and 46 provide a high friction point which reduces the chance of unintentional release of the threads.

Because the anchoring device 10 is constructed of a relatively flat material and the attachment members 18 and 20 are substantially symmetrical, the device 10 can be attached to garment 12 as shown or in other orientations. Thus device 10 can engage button threads from the left or the fight side of the buttons 24 and 26, and either attachment member 18 or 20 may be the upper attachment member to engage the button threads of button 24.

When the main member 15 has been inserted through the tie loop 22 and the attachment members 18 and 20 have engaged the button threads of buttons 24 and 26, the device 10 has a substantially vertical orientation with the access slots having a horizontal orientation. The narrow width and relatively thin material of base member 15 allows tie 23 to move vertically and horizontally limited by the width of the tie loop 22 and the distance between the tie loop 22 and buttons 24 and 26. Although the width of the anchoring device 10 allows the entire device to pass through tie loop 22, the attachment members 18 and 20 are wider than base member 15 for additional strength which makes device 10 more durable and for creating surfaces 52 and 54 which provide a useful surface for gripping the device 10. The surfaces 52 and 54 are rounded to allow the tie loop 22 to easily move the distance between the button threads engaged by anchoring device 10. As a result, the tie 23 is effectively anchored and lays flat and smooth on the wearer's garment 12, but tie 23 appears natural because it is capable of limited vertical and horizontal movement.

The anchoring device 10 may be easily removed by sliding attachment members 18 and 20 away from buttons 24 and 26. If device 10 has been moved vertically downward, it should be moved upward before removal. Release guide 40 insures that the button threads are properly aligned with access slot 34. As the anchoring device 10 is removed, the button threads may temporarily deform extended portions 30 and 32 to expand access slot 34. Once the attachment members have been removed from the button threads, anchoring device 10 can be removed from tie 23 by sliding the device out of tie loop 22. Therefore, a single anchoring device 10 can be used to anchor any tie to any buttoned shirt.

Anchoring device 10 effectively retains the extended portions of neckwear without damaging any of the fabric and without permanently attaching the device 10 to the tie 23. The positioning of the device 10 behind tie 23 hides the device from frontal view, and if device 10 is constructed of a transparent plastic, device 10 remains unseen if the wearer leans forward. The anchoring device 10 can be inexpensively manufactured by a single die cut which produces a unitary device. The device can be adapted to carry a logo, slogan, or advertisement. Finally, the attachment members 18 and 20 can be integrally formed with base member 15.

In another embodiment, the device could have a length adapted to attach to the button threads of non-adjacent buttons, or have a single slot which attaches to the button threads of only one button. The device could also be manufactured material other than transparent plastic.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

What is claimed is:

1. A device for loosely anchoring the extended portions of neckwear on a garment of a person where the garment has a plurality of spaced buttons attached by button threads, the device comprising:

an elongated and substantially vertical base member having a first end portion and an oppositely disposed second end portion, having a width adapted to be loosely received by a tie loop on the extended portion of neckwear, wherein the first end portion is disposed above the second end portion;

a first attachment member disposed on the first end of the base member, the first attachment member forming a vertically disposed first retaining slot and a horizontally disposed first access slot, the first access slot disposed between the first retaining slot an edge of the attachment member, whereby button threads of a first button on the garment are slidably engaged by the first retaining slot through the access slot as the first attachment member is positioned behind the first button;

a second attachment member disposed on the second end of the base member, the second attachment member forming a vertically disposed second retaining slot and a horizontally disposed second access slot, the second access slot disposed between the second retaining slot an edge of the attachment member, whereby button threads of a second button on the garment are slidingly engaged by the second retaining slot through the access slot as the second attachment member is positioned behind the second button; and the base member and the first and second attachment members are integrally formed of a resilient plastic material.

2. The device of claim 1, wherein:

the first access slot further comprises a first engagement guide and a first removal guide; and the second access slot further comprises a second engagement guide and a second removal guide.

3. The device of claim 1, wherein the distance between the first and second retaining slots is between about three and four inches.

4. The device of claim 1, wherein:

the first attachment member further comprises one or more retaining lips, the first attachment member having rounded edges so that the resilient plastic material will not snag the neckwear or garment; and the second attachment member further comprises one or more retaining lips, the second attachment member having rounded edges so that the resilient plastic material will not snag the neckwear or garment.

5. The device of claim 1, wherein:

the first attachment member can be temporarily deformed to expand the width of the first access slot.

the second attachment member can be temporarily deformed to expand the width of the second access slot.

6. The device of claim 1 wherein:

the distance between the first and second retaining slots is about three inches; and the length of each retaining slot is about 0.5 inches, whereby the anchoring device can be used on a garment with a button spacing of at least about three inches but not more than about four inches.

7. The device of claim 1 wherein the base member is narrower than the first and second attachment members whereby the neckwear is capable of greater horizontal movement and the first and second attachment members are sufficiently strong to resist breakage.

8. A device for loosely anchoring the extended portions of neckwear on a garment of a person where the garment has a plurality of spaced buttons attached by button threads, the device comprising:

an elongated base member having a first end portion and an oppositely disposed second end portion;

a first attachment member forming a first retaining slot and a first access slot, the first access slot disposed adjacent to and connecting with the first retaining slot and extending to the edge of the first attachment member, the first attachment member disposed on the first end of the base member and having a width adapted to be loosely received by a tie loop on the extended portion of neckwear;

a second attachment member forming a second retaining slot and a second access slot, the second access slot disposed adjacent to and connecting with the second retaining slot and extending to the edge of the second attachment member, the second attachment member disposed on the second end of the base member and having a width adapted to be loosely received by a tie loop on the extended portion of neckwear; and the first and second attachment members integrally formed with the base member to form a unitary structure formed of a resilient flexible material, whereby the first attachment member can engage the threads of a first button on the garment and the second attachment member can engage the threads of a second button on the garment to dispose the base member is a substantially vertical position between the first and second buttons.

9. The device of claim 8 wherein:

the base member having a width narrower than the first and second attachment members allowing greater lateral movement of the tie; and the first and second attachment member having rounded edges so that the resilient flexible material will not snag the neckwear or garment.

10. The device of claim 9 wherein:

the first access slot is horizontally disposed and the first retaining slot is vertically disposed, the first access slot further comprises a first engagement guide and a first removal guide, the first removal guide forming a retaining lip, wherein the first attachment member can be temporarily deformed to expand the width of the first access slot; and the second access slot is horizontally disposed and the second retaining slot is vertically disposed, the second access slot further comprises a second engagement guide and a second removal guide, the second removal guide forming a retaining lip, wherein the second attachment member can be temporarily deformed to expand the width of the second access slot.

11. The device of claim 10 wherein:

the minimum distance between the first and second retaining slots is about 3.0 inches; and the first and second retaining slots are each about 0.5 inches in length, whereby the anchoring device can be used on any garment having adjacent buttons spaced between about 3.0 inches and about 4.0 inches.

* * * * *